US010883359B2

(12) United States Patent
Stokes et al.

(10) Patent No.: US 10,883,359 B2
(45) Date of Patent: Jan. 5, 2021

(54) REMOVING A CASING SECTION IN A WELLBORE

(71) Applicant: Wellbore Integrity Solutions LLC, Houston, TX (US)

(72) Inventors: David A. Stokes, The Woodlands, TX (US); James Bain, Aberdeen (GB); Walter E. Friedl, Houston, TX (US); Douglas A. Pipchuk, London (GB)

(73) Assignee: Wellbore Integrity Solutions LLC, Houston, TX (US)

( * ) Notice: Subject to any disclaimer, the term of this patent is extended or adjusted under 35 U.S.C. 154(b) by 0 days.

(21) Appl. No.: 15/752,924

(22) PCT Filed: Aug. 4, 2016

(86) PCT No.: PCT/US2016/045648
§ 371 (c)(1),
(2) Date: Feb. 15, 2018

(87) PCT Pub. No.: WO2017/030806
PCT Pub. Date: Feb. 23, 2017

(65) Prior Publication Data

US 2018/0245450 A1 Aug. 30, 2018

Related U.S. Application Data

(60) Provisional application No. 62/206,493, filed on Aug. 18, 2015.

(51) Int. Cl.
*E21B 47/005* (2012.01)
*E21B 29/00* (2006.01)
(Continued)

(52) U.S. Cl.
CPC ..... *E21B 47/005* (2020.05); *E21B 29/005* (2013.01); *E21B 29/02* (2013.01); *E21B 33/134* (2013.01)

(58) Field of Classification Search
CPC ..... E21B 29/00; E21B 29/002; E21B 29/02; E21B 47/0005; E21B 33/13; E21B 47/005
See application file for complete search history.

(56) References Cited

U.S. PATENT DOCUMENTS 6,155,343 A 12/2000 Nazzal et al.
9,089,928 B2 * 7/2015 Zediker ..... E21B 29/02
(Continued)

FOREIGN PATENT DOCUMENTS

WO WO2014100269 6/2014

OTHER PUBLICATIONS

International Preliminary Report on Patentability issued in International Patent Application No. PCT/US2016/045648, dated Mar. 1, 2018, 8 pages.
(Continued)

*Primary Examiner* — Kenneth L Thompson
(74) *Attorney, Agent, or Firm* — Hubbard Johnston, PLLC

(57) ABSTRACT

Methods and tools for cutting a component in a wellbore are include use of a downhole tool that is tripped into a wellbore. The downhole tool includes at least one sensor that determines whether a quality of a cement around casing satisfies a predetermined standard. The casing is cut to remove an axial section of the casing and the at least one sensor determines whether at least a segment of the axial section of the casing remains adhered to the cement after the casing is cut. A casing removal tool can be activated to remove any remaining segments of casing in the axial section. A plug can be formed in the area where the axial segment of the casing was removed. The downhole tool may include a cutting tool with a laser, abrasive jet, or other cutting element shielded from wellbore debris by a fluid stream.

16 Claims, 9 Drawing Sheets

(51) Int. Cl.

| | |
|---|---|
| ***E21B 33/13*** | (2006.01) |
| ***E21B 33/134*** | (2006.01) |
| ***E21B 29/02*** | (2006.01) |

(56) References Cited

U.S. PATENT DOCUMENTS

| | | | | |
|---|---|---|---|---|
| 9,383,473 | B2 * | 7/2016 | Guo | E21B 47/0005 |
| 9,664,012 | B2 * | 5/2017 | Deutch | E21B 29/00 |
| 9,822,629 | B2 * | 11/2017 | Suparman | E21B 29/00 |
| 10,202,814 | B2 * | 2/2019 | Fuller | E21B 29/005 |
| 2005/0263282 | A1 | 12/2005 | Jeffrey et al. | |
| 2008/0277118 | A1 | 11/2008 | McAfee | |
| 2015/0144340 | A1 | 5/2015 | Surjaatmadja et al. | |

OTHER PUBLICATIONS

International Search Report and Written Opinion issued in International Patent Application No. PCT/US2016/045648, dated Nov. 18, 2016, 11 pages.

Leeson, Tom; Abrasive Casing Removal; Halliburton; 2013; 17 pages.

* cited by examiner

REMOVING A CASING SECTION IN A WELLBORE

CROSS-REFERENCE TO RELATED APPLICATIONS

This application claims the benefit of, and priority to, U.S. patent application Ser. No. 62/206,493, filed Aug. 18, 2015, and entitled "Removing a Casing Section in a Wellbore," which application is expressly incorporated herein by this reference in its entirety.

BACKGROUND

During after or drilling of a wellbore, a casing may installed. Installation of the casing may include forming an annular layer of cement radially-between the wellbore wall and the casing. The casing may remain installed during well operations, potentially including wellbore abandonment operations. For example, during wellbore abandonment the annular layer of cement may be analyzed through the casing. If the cement is of sufficient quality, additional cement may be pumped into the wellbore and inside the casing to create a cement plug that limits the flow of fluids axially through the cement plug.

If the cement is not of sufficient quality, a section mill may be run into the wellbore to mill away an axial section of the casing. Cement may then be pumped into the wellbore and allowed to form a cement plug in the area where the casing was removed. Optionally, an underreamer may be run into the wellbore to remove the cement in the area that has been section milled, and to expose the outer formation. In this scenario, the cement plug may be formed and bonded to the formation itself.

SUMMARY

Some embodiments of the present disclosure relate to methods that include running a downhole tool into a cased wellbore. The downhole tool may include at least one sensor used to determine whether the quality of cement in an annulus around the casing satisfies a predetermined standard. The casing may also be cut to remove an axial section of the casing and the sensor can be used to determine whether a portion of the axial section of the casing remains adhered to the cement after cutting. A plug may also be formed at least partially in the axial section where the casing was cut.

According to the same or other embodiments, a method for abandoning a wellbore includes running a downhole cutting tool into a wellbore. An axial section of casing within the wellbore is cut using the downhole cutting tool, and one or more sensors are used to determine that one or more segments of casing remain adhered to cement within the axial section of casing. Thereafter, the one or more segments of casing are removed using one or more casing removal tools, and a plug is formed in a location that at least partially includes where the axial section of casing was cut.

In some embodiments, a downhole tool includes a body defining an opening through which a stream of fluid is configured to flow in a radially-outward direction. At least one sensor is coupled to the body and configured to measure quality of cement and determine whether portions of casing remain adhered to cement after cutting of the casing. A cutting tool is also coupled to the body and configured to cut an axial section of casing, a completion assembly, or both. In some embodiments, the cutting tool may include a laser, abrasive jet, plasma mill, torch, or combinations thereof. Optionally, the stream of fluid may at least partially surround a cutting element of the cutting tool to protect the cutting element from wellbore debris. In further example embodiments, the downhole tool may include a casing removal tool to remove the portions of casing which remain adhered to the cement after cutting.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

So that the recited features may be understood in detail, a more particular description, briefly summarized above, may be had by reference to one or more embodiments, some of which are illustrated in the appended drawings. It is to be noted, however, that the appended drawings are illustrative embodiments, and are, therefore, not to be considered limiting of its scope.

DETAILED DESCRIPTION

Some embodiments described herein generally relate to downhole tools. Some embodiments relate to systems and methods for removing an axial section of casing in a wellbore. Some embodiments relate to systems and methods for verifying that an axial section of casing has been removed in a wellbore. Some embodiments described herein relate to systems and methods for plugging and/or abandoning a wellbore.

Figure 1:
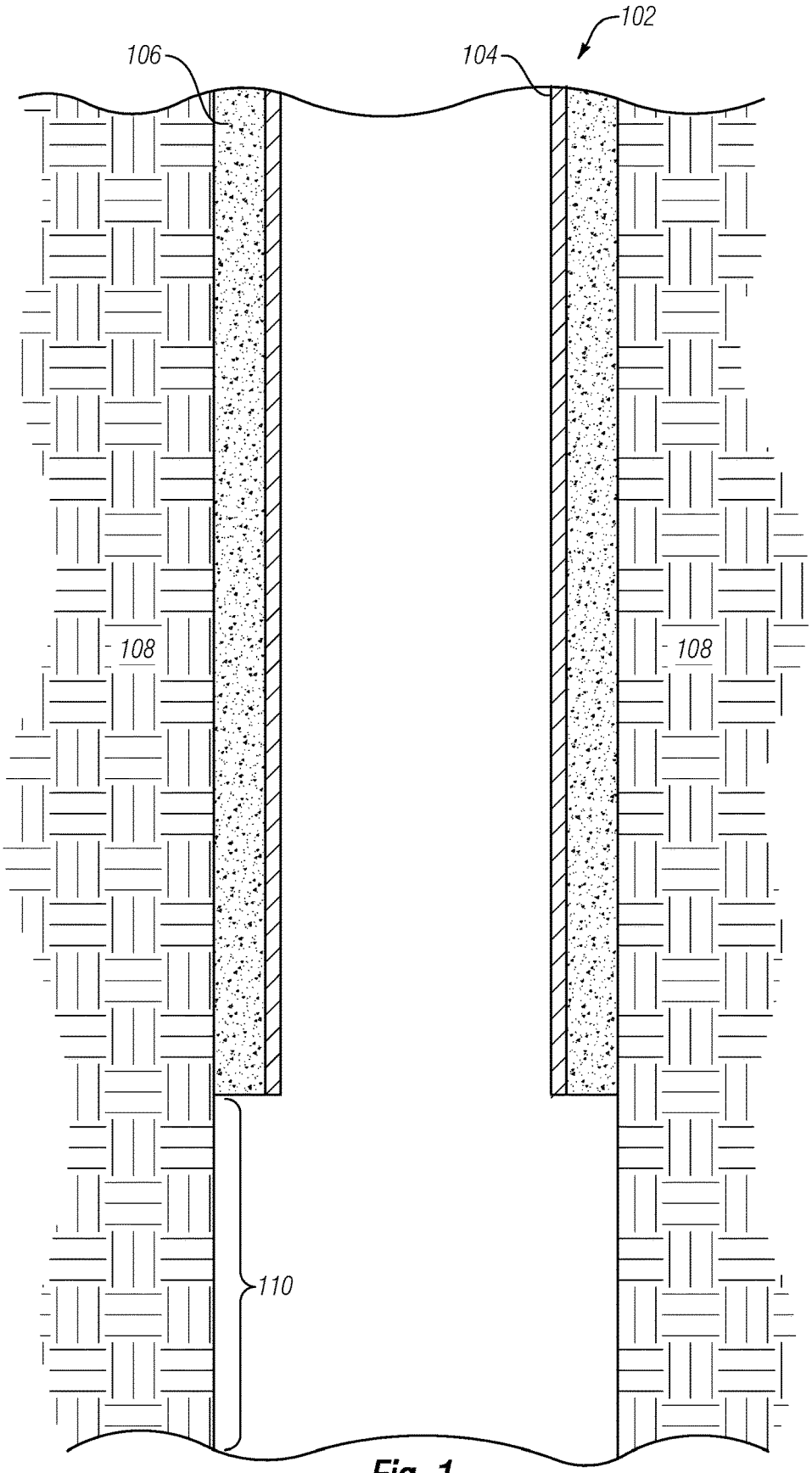
FIG. 1 is a cross-sectional view of a wellbore having casing installed in a portion thereof, according to one or more embodiments disclosed.

Turning now to FIG. 1, a cross-sectional view of a wellbore 102 is shown according to one or more embodiments disclosed. The wellbore 102 may have a casing 104 positioned therein. The casing 104 may be secured in place by an annular layer of cement 106 that is positioned radially-between the casing 104 and a subterranean formation 108. Optionally, below the casing 104 may be an uncased or "openhole" segment 110 of the wellbore 102. Although a single casing 104 is shown in FIG. 1, a person having ordinary skill in the art will appreciate in view of the disclosure herein that a wellbore may have multiple casings of various sizes installed therein. Thus, the casing 104 may represent multiple nested casings/liners within the wellbore 102.

Figure 2:
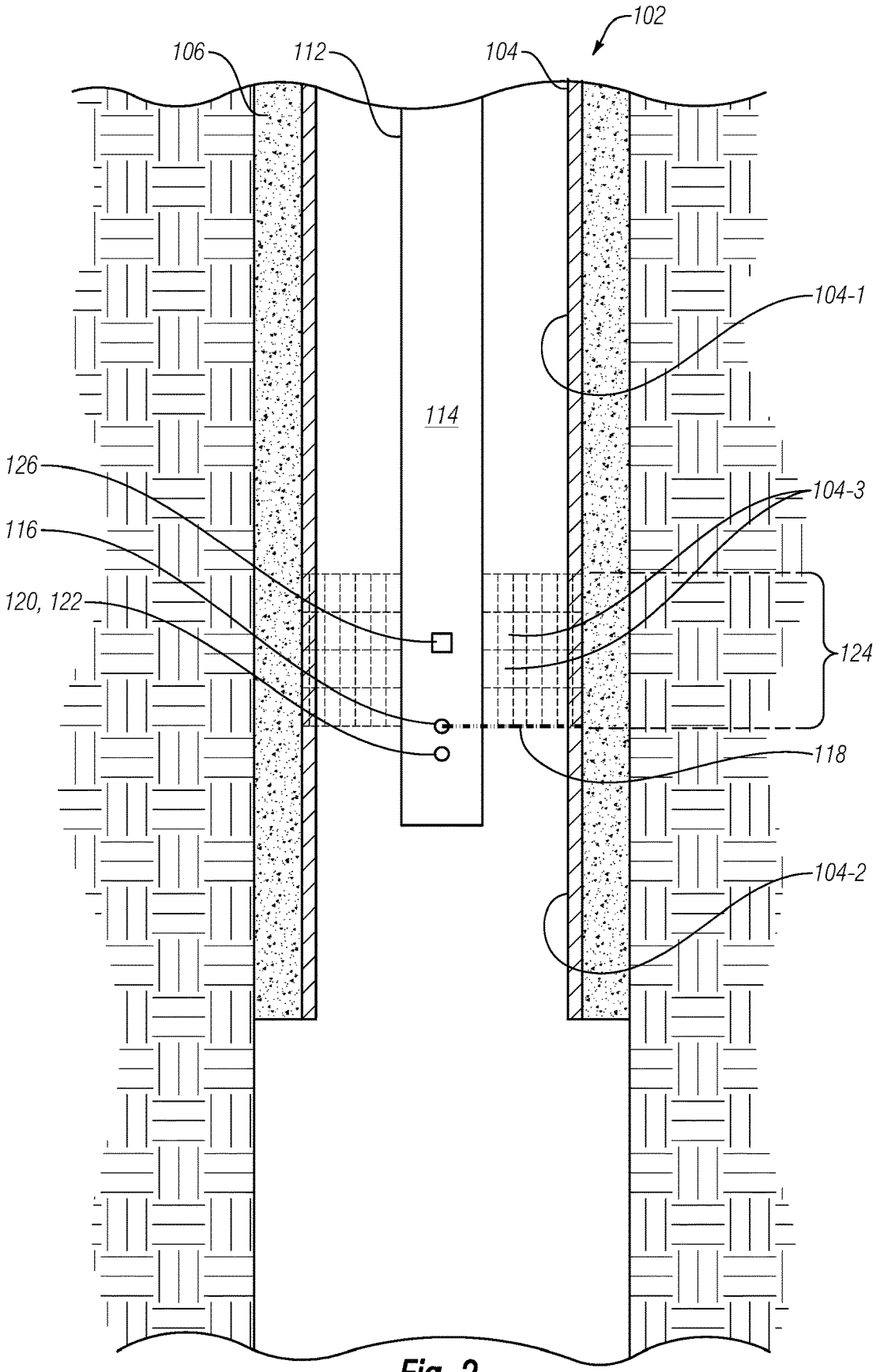
FIG. 2 is a cross-sectional view of a wellbore with a downhole cutting tool cutting the casing, according to one or more embodiments disclosed.

FIG. 2 is a cross-sectional view of the wellbore 102 of FIG. 1, and further shows a downhole cutting tool 112 being run inside the wellbore 102, according to one or more embodiments disclosed. The downhole cutting tool 112 may include a body 114 of a tubular or other shape or configuration. In some embodiments, the body 114 may have an axial bore extending at least partially therethrough.

The downhole cutting tool 112 may be configured to measure quality of the cement 106 and/or to cut/mill downhole components, pipe, casing, or the like. In some embodiments, different tools may be used to measure the quality of the cement 106 and to perform a downhole cutting operation. Where the same tool may be used for both purposes, the downhole cutting tool 112 may be used to determine whether the quality of the cement 106 meets or satisfies a predetermined standard (e.g., a governmentally imposed minimum cement quality standard) using a sensor 126 coupled to the downhole cutting tool 112. The sensor 126 may be a cement measurement tool configured to measure/log the porosity, thickness, permeability, channeling, micro-annuli, cement interface, other features, or combinations of the foregoing of the cement 106 (e.g., through the casing 104). The measurements may be transmitted uphole, or processed downhole, to allow a user and/or processor to determine whether the cement 106 satisfies the predetermined standard. As will be appreciated by one having ordinary skill in the art, particularly in view of the disclosure herein, the predetermined standard may vary for different countries or jurisdictions.

If the quality of the cement 106 meets the predetermined standard, then a fluid (e.g., additional cement or other wellbore plugging material) may be pumped down through the downhole cutting tool 112 (or another downhole tool) into the wellbore 102 to form a plug within the casing 104. If, however, the quality of the cement 106 does not meet the predetermined standard, the casing 104 and/or cement 106 may be at least partially removed as described herein.

For instance, according to at least some embodiments, the downhole cutting tool 112 may be a laser, abrasive jet, plasma, or torch cutter. One or more nozzles, lasers, or the like may be coupled to the body 114. In FIG. 2, for instance, one or more lasers 116 may be coupled to the body 114, and the lasers 116 may emit a pulse or beam of light 118 in a radially radially-outward direction. The light may be optically amplified (e.g., using stimulated emission of electromagnetic radiation) and may have sufficient power/intensity to cut into or even through the casing 106.

In some embodiments, the downhole cutting tool 112 may be rotated while the laser 116 cuts through the casing 104, thereby separating the casing 104 into first and second portions 104-1, 104-2. In the illustrated embodiment, the first portion 104-1 is shown as an upper portion and the second portion 104-2 is shown as a lower portion. This embodiment is merely illustrative. In other embodiments, for instance, the wellbore 102 may be a horizontal, lateral, deviated, or other directional wellbore, and the first and second portions 104-1, 104-2 may be left and right portions, or identified using other relational terms. In some embodiments, the downhole cutting tool 112 may also be raised and lowered to cut a portion of the casing between the first and second portions 104-1, 104-2 into a plurality of segments 104-3. As shown, the segments 104-3 are substantially rectangular; however, other shapes are also contemplated herein. In some embodiments, for instance, the segments 104-3 may have a rectangular, square, triangular, or other cross-sectional shape. In some embodiments, the segments 104-3 may be elongate and form strips. In some additional examples, the downhole cutting tool 112 may be raised, lowered, rotated, or a combination thereof to cut a helical pattern into the casing 104. This may transform the segment 104-3 into helical "ribbons." Of course, the segments 104-3 may have other shapes and combinations of the foregoing. Although FIG. 2 shows the downhole cutting tool 112 cutting the casing 104 with a laser 116, in other embodiments, the downhole cutting tool 112 may cut the casing 104 using another type of cutting tool such as a plasma mill, torch cutter, or an abrasive jet.

According to some embodiments, the body 114 may define or include one or more radial openings 120 (one is shown). Optionally, the radial opening 120 may be proximate the laser 116 or other cutting element; however, such positioning is optional. The opening 120 may include a nozzle or other flow-restricting device 122 positioned therein. Fluid may be pumped radially-outwardly through the opening 120 in a concentrated stream toward the casing 104. The stream may have a velocity sufficient to restrict and potentially prevent debris from passing therethrough. In some embodiments, the beam of light 118 may extend at least partially through (e.g., be fully or partially surrounded by) the stream of fluid. The stream of fluid may provide a "clean environment" for the laser 116. In the clean environment, debris may be restricted or even prevented from fully or partially obstructing the path of the beam of light 118 of the laser 116, which would hinder cutting ability. The fluid flowing from the opening 120 may be, for example, clear water or nitrogen. In at least one embodiment, the downhole cutting tool 112 may include both the laser 116 and an abrasive jet (not shown).

Figure 3:
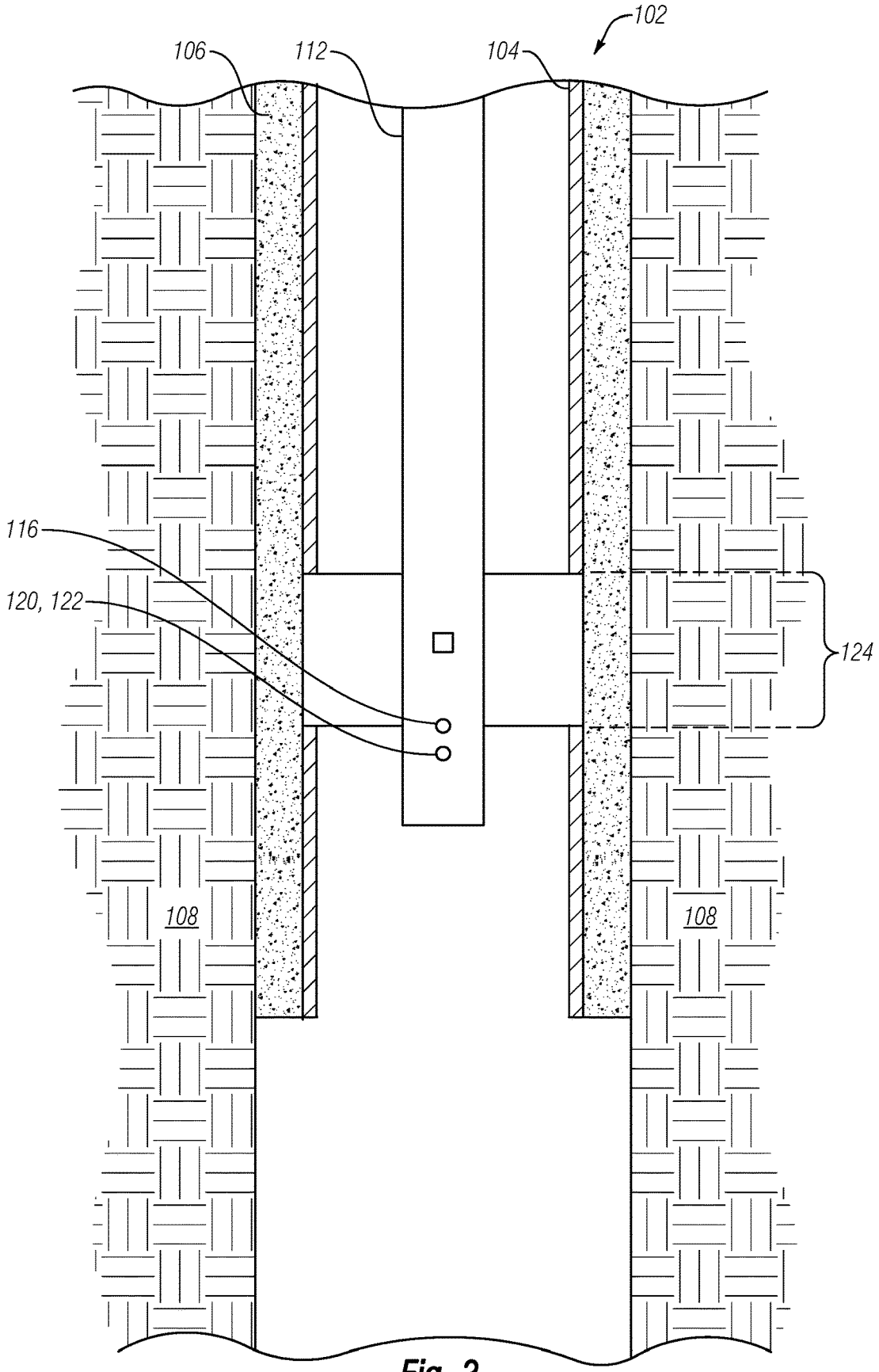
FIG. 3 is a cross-sectional view of a wellbore following cutting and removal of an axial section of the casing, according to one or more embodiments disclosed.

In FIG. 2, the laser 116 (or abrasive jet, plasma mill, torch cutter, etc.) cutting the casing 104 may cause the segments 104-3 to be formed. The segments 104-3 may collectively make-up an axial section 124 of the casing 104. The axial section 124 may be removed, according to one or more embodiments disclosed. FIG. 3, for instance, illustrates the casing 104 with the axial section 124 (and corresponding segments 104-3) of FIG. 2 removed. When removed, the segments 104-3 may, in some embodiments, either fall into the sump of the wellbore 102 or be pulled upward and out of the wellbore 102 (e.g., using circulating fluid, the downhole cutting tool 112, etc.).

In at least one embodiment, the residual hoop stress exerted on the casing 104 may cause the segments 104-3 of the casing 104 to bend or flex radially-inward such that the segments 104-3 may release from the cement 106 and fall into the sump of the wellbore 102. In other embodiments, the stream of fluid that optionally accompanies the laser 116 may cause or assist in breaking the bonds between the segments 104-3 of the casing 104 and the cement 106 to break, allowing the segments 104-3 to release from the cement 106 and fall into the sump of the wellbore 102.

In some embodiments, heat from the laser 116 (or one or more additional or other lasers coupled to the downhole cutting tool 112) may cause the segments 104-3 of the casing 104 to expand, which may cause the segments 104-3 to release from the cement 106 and fall into the sump of the wellbore 102. For example, the focal range of the laser 116 may be adjusted after the casing 104 has been cut. The new focal range may have a lesser intensity that may heat the casing 104 without introducing further cuts. Optionally, adjusting of the intensity may occur while the downhole cutting tool 112 remains downhole (e.g., using surface controls or downhole processing and controls), or may occur after tripping the downhole cutting tool 112 out of the wellbore 102 and subsequently tripping the downhole cutting tool 112 back into the wellbore 102.

In some embodiments, the focal range and/or intensity of one or more lasers 116 may be adjusted for other reasons. For instance, the wellbore 102 may include multiple casings 106, or casings 106 of multiple sizes. The focal range and/or intensity may be adjusted if the lasers 116 are to cut through multiple casings, or depending on the distance between the downhole cutting tool 112 and the casing 106 to be cut. In some embodiments, the one or more sensors 126 (e.g., a proximity sensor, magnetic sensor, etc.) may detect the presence of casing 104 and/or the distance between the casing 104 and the downhole cutting tool 112 to allow dynamic, downhole adjustments of the lasers 116 for cutting the casing 104.

Figure 4:
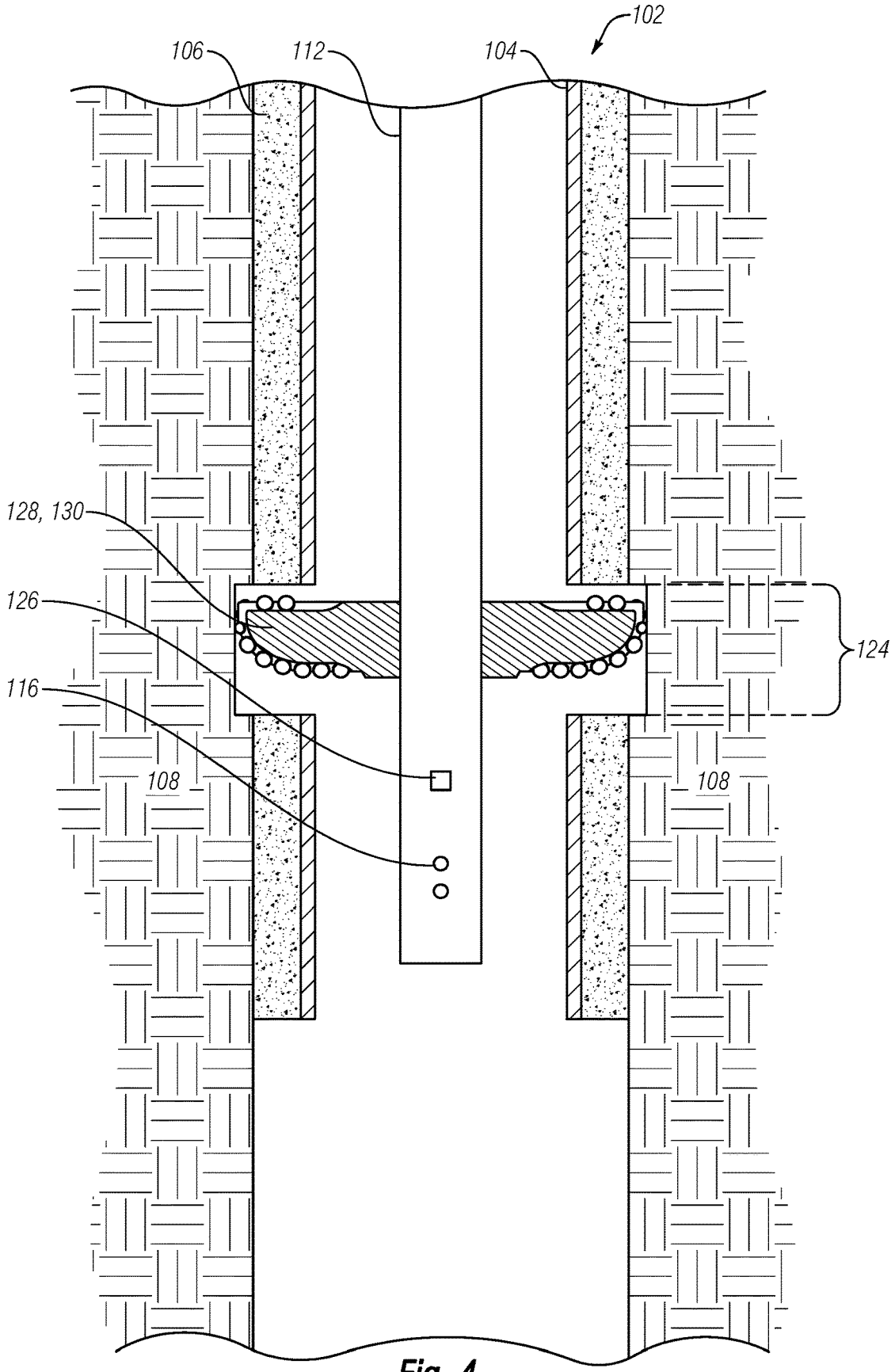
FIG. 4 is a cross-sectional view of a wellbore with an underreamer of a downhole cutting tool removing at least a portion of the cement where an axial section of the casing was removed, according to one or more embodiments disclosed.

In some embodiments, when the axial section 124 of casing 106 is removed, a portion of the cement 106 may remain. Optionally, the cement 106 aligned with the axial section 124 may be fully or partially removed to expose the formation 108. FIG. 4 is a cross-sectional view of the wellbore 102 showing an underreamer 128 removing at least a portion of the cement 106 in the area of the wellbore 102 where the axial section 124 of casing 104 was removed, according to one or more embodiments disclosed. In at least one embodiment, the downhole cutting tool 112 may include an underreamer 128.

In other embodiments, a different downhole tool with the underreamer 128 may be run into the wellbore 102.

The underreamer 128 may include one or more arms, knives, or other cutter blocks 130 that may be actuated radially-outward from a retracted position to an expanded position. When the cutter blocks 130 are in the expanded position (as shown in FIG. 4), the underreamer 128 may remove (e.g., cut or grind away) the cement 106 where the axial section 124 of the casing 104 was removed. As shown, the underreamer 128 has removed at least a portion of the cement 106 where the axial section 124 of casing 104 was removed. In addition, the underreamer 128 may also remove or expose at least a portion of the formation 108 positioned radially-outward from the cement 106.

Figure 5:
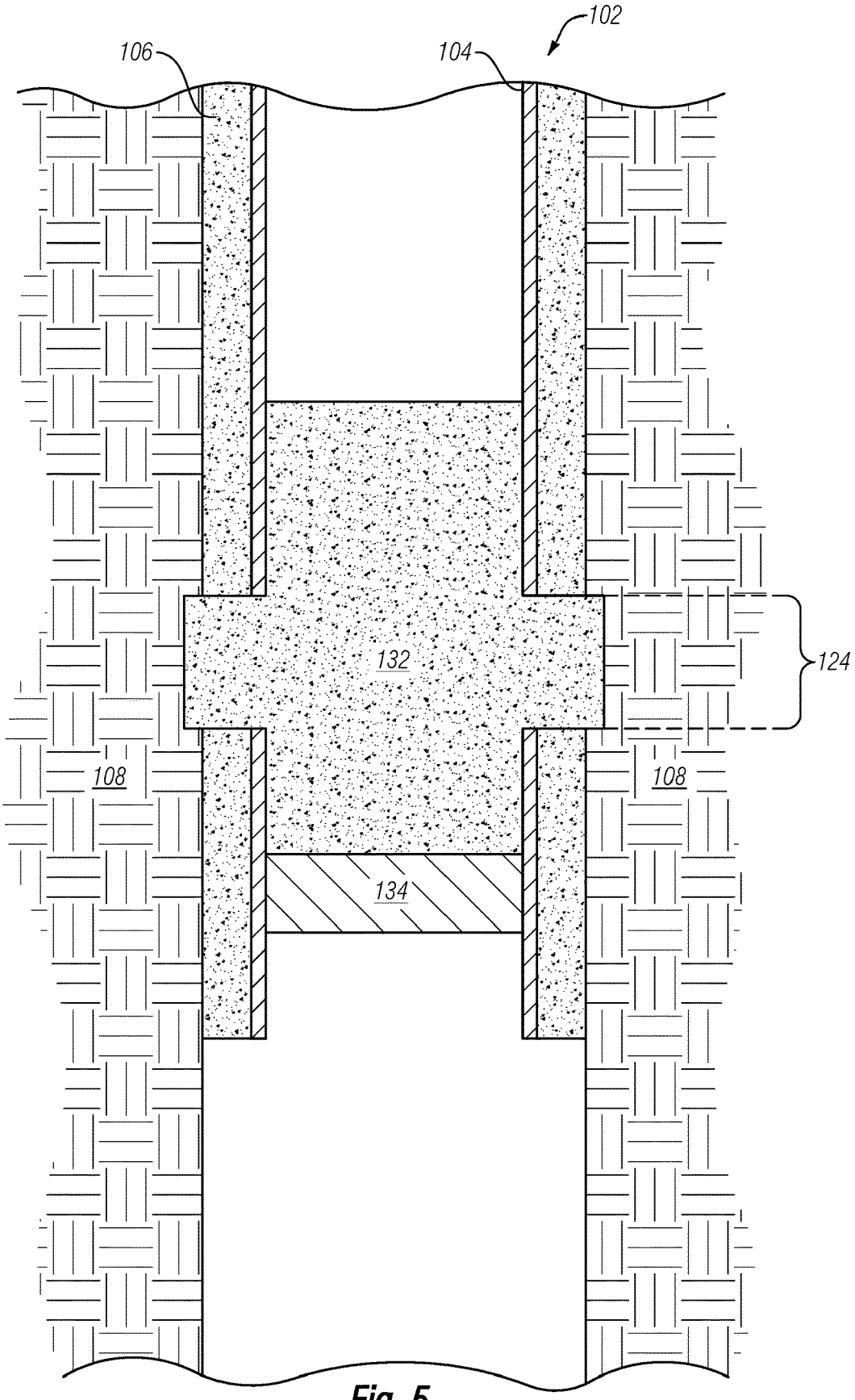
FIG. 5 is a cross-sectional view of a wellbore showing a cement plug at least partially formed where an axial section of casing was removed, according to one or more embodiments disclosed.

FIG. 5 is a cross-sectional view of the wellbore 102 showing a cement plug 132 at least partially in the gap where the axial section 124 of casing 104 was removed, according to one or more embodiments disclosed. Once the cement 106 has been removed by the underreamer 128 (FIG. 4), plugging materials (e.g., fluids such as cement and epoxy) may be pumped into the wellbore 102 to form the plug 132 where the axial section 124 of casing 104 was removed. The plugging materials may be pumped through the downhole cutting tool 112, although in other embodiments the downhole cutting tool 112 may be raised to the surface, a different downhole tool may be run into the wellbore 102, and the plugging materials may be pumped through the different downhole tool. In still other embodiments, other or additional plugging materials may be used. For instance, metals or metal alloys may be used instead of a fluid. Such materials may be provided downhole and heat may be applied to the materials (e.g., using the lasers 116 or other heating materials) to bring the temperature of the materials above their melting temperature to allow the materials to flow into the axial section 124 and form the plug 132.

In some embodiments, a support device 134 such as a packer or bridge plug may be installed in the casing 104 or other portion of the wellbore 102. The support device 134 may be used to support or isolate a section of the wellbore 102 on which the plug 132 is formed (e.g., when the plug 132 is formed off-bottom). The support device 134 may be coupled to the downhole cutting tool 112 and installed in a single trip with cutting of the casing 104, although in other embodiments a separate trip may be used to install the support device 134. Regardless of the particular manner of forming the plug 132, the plug 132 may span the diameter of the wellbore 102 (e.g., formation-to-formation in reamed portion of the axial section 124, and the internal diameter of the casing 104 above and/or below the axial section 124) and restrict and potentially prevent fluid from flowing axially through the plug 132.

Figure 6:
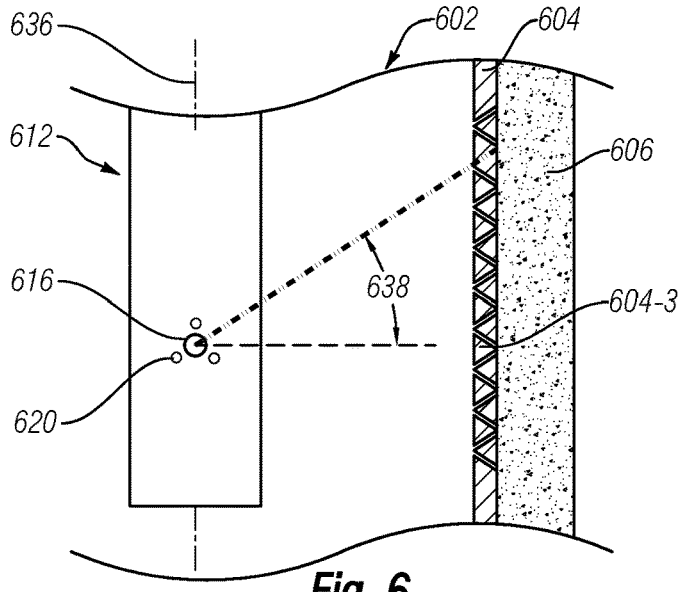
FIG. 6 is a cross-sectional view of a portion of a wellbore showing a downhole cutting tool cutting through the casing at an angle that is not perpendicular to a central longitudinal axis of the casing or downhole cutting tool, according to one or more embodiments disclosed.

According to some embodiments, cutting of the casing 104 and/or verifying the casing 104 has been removed may be performed prior to forming the plug 132. FIG. 6, for instance, is a cross-sectional view of another embodiment of a wellbore 602 showing a laser 616 of a downhole cutting tool 612 cutting through a casing 604. In at least some embodiments, the angle at which the laser 616 cuts through the casing 604 may not be perpendicular to a central longitudinal axis 636 through the casing 604. The laser 616 may be oriented slightly upward or downward at an angle 638 with respect to the central longitudinal axis 636 so that the casing 604 is cut at this angle 638. In some embodiments, the angle 638 may be between 1° and 45°. For instance, the angle 638 may be, relative to the longitudinal axis 636, within a range having lower and/or upper limits including any of 1°, 2.5°, 5°, 10°, 20°, 30°, 40°, 45°, and values therebetween. For instance, the angle 638 may be between 2° and 30°, between 5° and 20°, up to 30°, or less than 10°. In other embodiments, the angle 638 may be less than 1° (e.g., 0° and perpendicular to the longitudinal axis 636).

In one or more embodiments, the laser 616 may be oriented at a downward angle when cutting through the casing 604 to define an upper surface of one of the segments 604-3 and oriented at an upward angle when cutting through the casing 604 to define a lower surface of the same one of the segments 604-3. This configuration may form a wedge-shaped (e.g., triangular or trapezoidal) cross-section that may facilitate separation of the segments 604-3 from the cement 606, particularly when the segment 604-3 expands due to heating, as discussed above. As the segments 604-3 expand (e.g., axially), the interface between the sloped upper and lower surfaces of the segments 604-3 and the corresponding surfaces of the surrounding casing 604 may form a ramped or other surface that causes or facilitates moving the segment 604-3 radially-inward until the segment 604-3 separates from the cement 606 and falls (e.g., into the sump of the wellbore 602 or onto a bridge plug or other support device).

In some embodiments, this technique may cause about 50% of the segments 604-3 to have minimal or no remaining contact with the cement 606. As such, there may be nothing holding these segments 604-3 in place, and the segments 604-3 may fall within the wellbore 602. At least some of the remaining segments 604-3 may remain adhered to the cement 606. In some embodiments, as discussed herein, the removed segments 604-3 may form recesses or notches that may make the remaining segments 604-3 easier to remove at a later time.

According to some embodiments, the downhole cutting tool 612 may define or include one or more radial openings 620 (three are shown). Optionally, the radial openings 620 may be proximate the laser 616 or other cutting element; however, such positioning is optional. In some embodiments, the radial openings 620 may be positioned at least partially around the laser 616. Fluid may be pumped radially-outwardly through the openings 620 toward the casing 604 and used to restrict and potentially prevent debris from passing therethrough. In some embodiments, a beam from the laser 616 may extend at least partially through, or be fully or partially surrounded by, the streams of fluid output by the radial openings 620. The streams of fluid may provide a clean environment for the laser 616 in which the beam from the laser 616 may be unobstructed or have limited obstructions.

Figure 7:
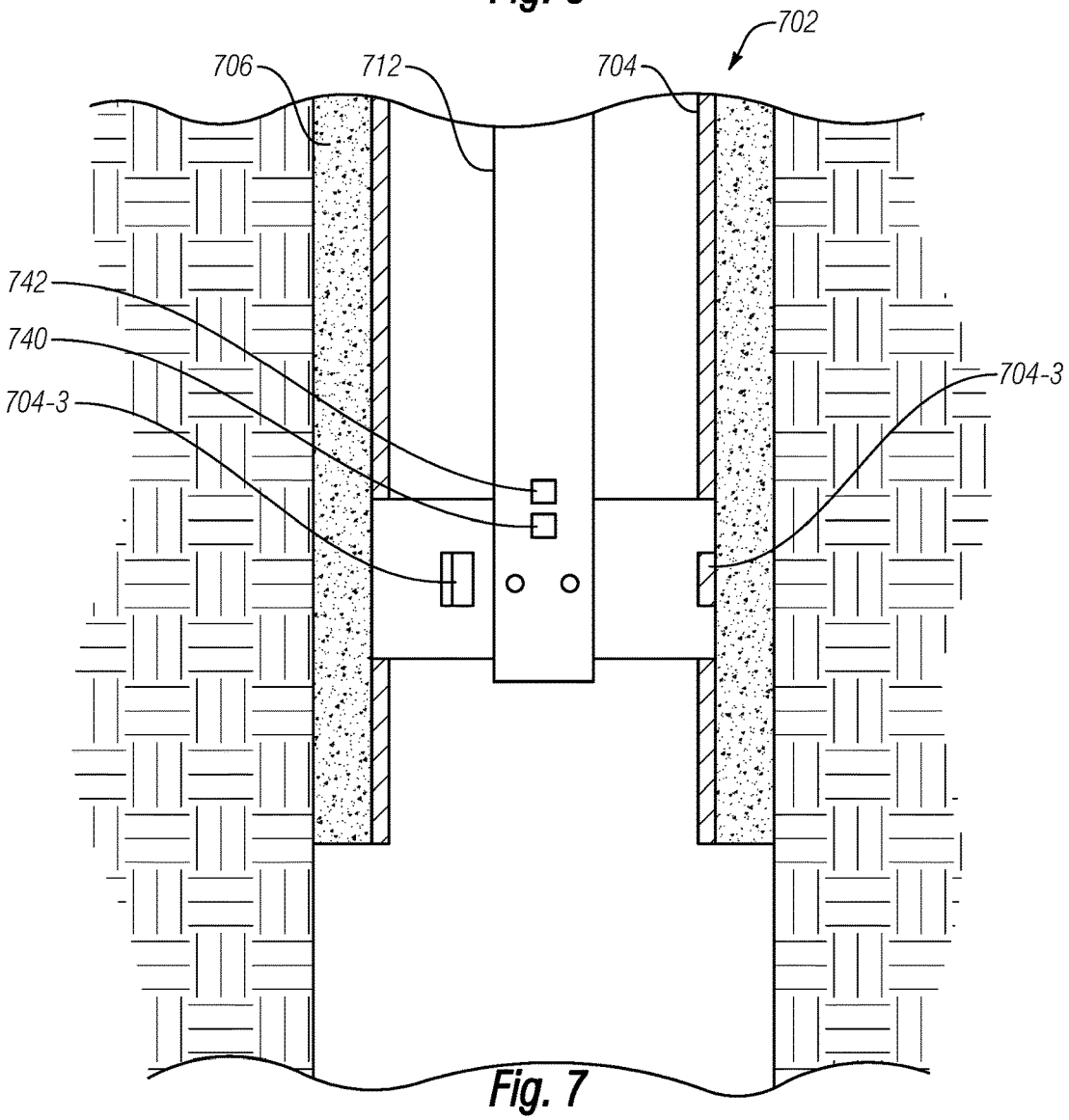
FIG. 7 is a cross-sectional view of a wellbore showing one or more portions of a section of casing that remain adhered to the cement after the section of casing has been cut, according to one or more embodiments disclosed.

FIG. 7 is a cross-sectional view of another wellbore 702 showing one or more segments 704-3 of casing 704 which remain adhered to the cement 706 after the casing 704 has been cut, and a remainder of the segments 704-3 have fallen or otherwise been removed, according to one or more embodiments disclosed. In some embodiments, the downhole cutting tool 712 may include one or more casing detection tools 740 (one is shown). A casing detection tool 740 may assist an operator at the surface or a downhole processor/controller in determining whether one or more of the segments 704-3 of the casing 704 remain adhered to the cement 706 after the casing 704 has been cut. In some embodiments, the casing detection tool 740 may include a camera allows a user to visually determine whether one or more segments 704-3 of the casing 704 remain adhered to the cement 706. The camera may be an infrared camera, a fiber optic camera, and the like. The camera may also have a light coupled thereto.

In the same or other embodiments, the casing detection tool 740 may include a sensor configured to transmit a signal that bounces off the casing 704 or the cement 706 and returns to the sensor. In one example, the signal may be an acoustic pressure pulse. The sensor or a processor in communication with the sensor may be configured to determine whether the signal is bouncing off of the casing 704 or the cement 706 based at least partially upon the travel time of the signal or changes to (e.g., attenuation of) the signal in response to the surface that it contacts.

In yet additional embodiments, the casing detection tool 740 may include a magnetometer. The magnetometer may be configured to detect one or more metals, such as iron. As the casing 704 may be made from metal while the cement 706 may be made primarily of non-metallic or non-ferrous materials, the magnetometer may be configured to detect whether a segment 704-3 of the casing 704 is still present within the area being measured.

In still additional embodiments, the casing detection tool 740 may include one or more radially-expandable components (e.g., arms). The arms may be expanded radially-outwardly to contact the cement 706. The downhole cutting tool 712 may then be raised or lowered in the wellbore 702, and the arms may slide along the cement 706. The arms may be pushed radially-inwardly when they encounter the casing 704 or a segment 704-3 thereof. In this way, the arms may be used to detect whether a segment 704-3 of the casing 704 remains adhered to the cement 706.

In yet other embodiments, the casing detection tool 740 may be laser or other light emission device that functions as a micrometer. The micrometer may be configured to measure the distance between itself and a component (e.g., the cement 706 or a segment 704-3 of the casing 704) positioned radially-outwardly therefrom. The downhole cutting tool 712 may be raised or lowered in the wellbore 702, and the micrometer may help determine that a segment 704-3 of the casing 704 remains adhered to the cement 706 when the radial distance measured decreases (e.g., by the thickness of the casing 704 or more).

If it is determined that one or more segments 704-3 of the casing 704 remain adhered to the cement 706, one or more casing removal tools 742 (one is shown) coupled to the downhole cutting tool 712 may be used to separate or remove the segments 704-3 of the casing 704 from the cement 706. In at least one embodiment, the casing removal tool 742 may be configured to create a pressure pulse in the wellbore 702. For example, the casing removal tool 742 may include a propellant canister that is configured to generate a controlled pressure pulse that moves radially-outwardly toward the segments 704-3 that remain adhered to the cement 706. The pressure pulse may exert a force on a segment 704-3, thereby causing the segment 704-3 to separate from the cement 706.

In other embodiments, the casing removal tool 742 may include one or more radially-expandable components (e.g., arms). The arms may expand radially-outwardly to contact the cement 706. The downhole cutting tool 712 may then be rotated, raised, and/or lowered in the wellbore 702, and the arms may contact and pry loose any remaining segments 704-3 of the casing 704 that they encounter. For example, the arms may engage recesses or notches left by removed segments 704-3, which may facilitate the prying of the remaining segments 704-3 loose from the cement 706.

In yet another embodiment, the casing removal tool 742 may include an impact hammer Optionally, a back-whirl may be introduced into the hammer to allow the hammer to knock the segments 704-3 free from the cement 706.

Figure 8:
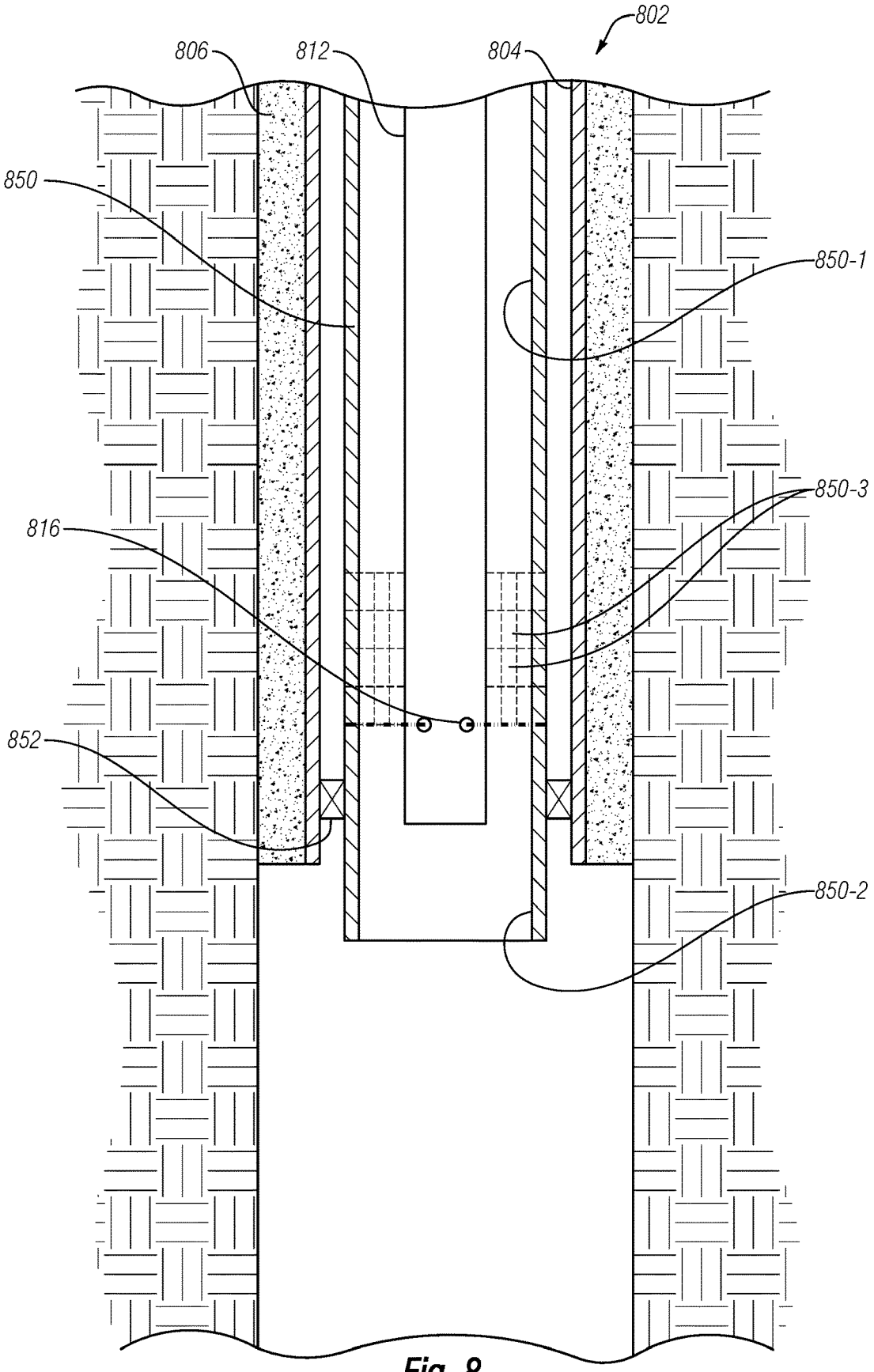
FIG. 8 is a cross-sectional view of a wellbore showing a downhole cutting tool cutting a downhole component within the casing of the wellbore, according to one or more embodiments disclosed.
Figure 9:
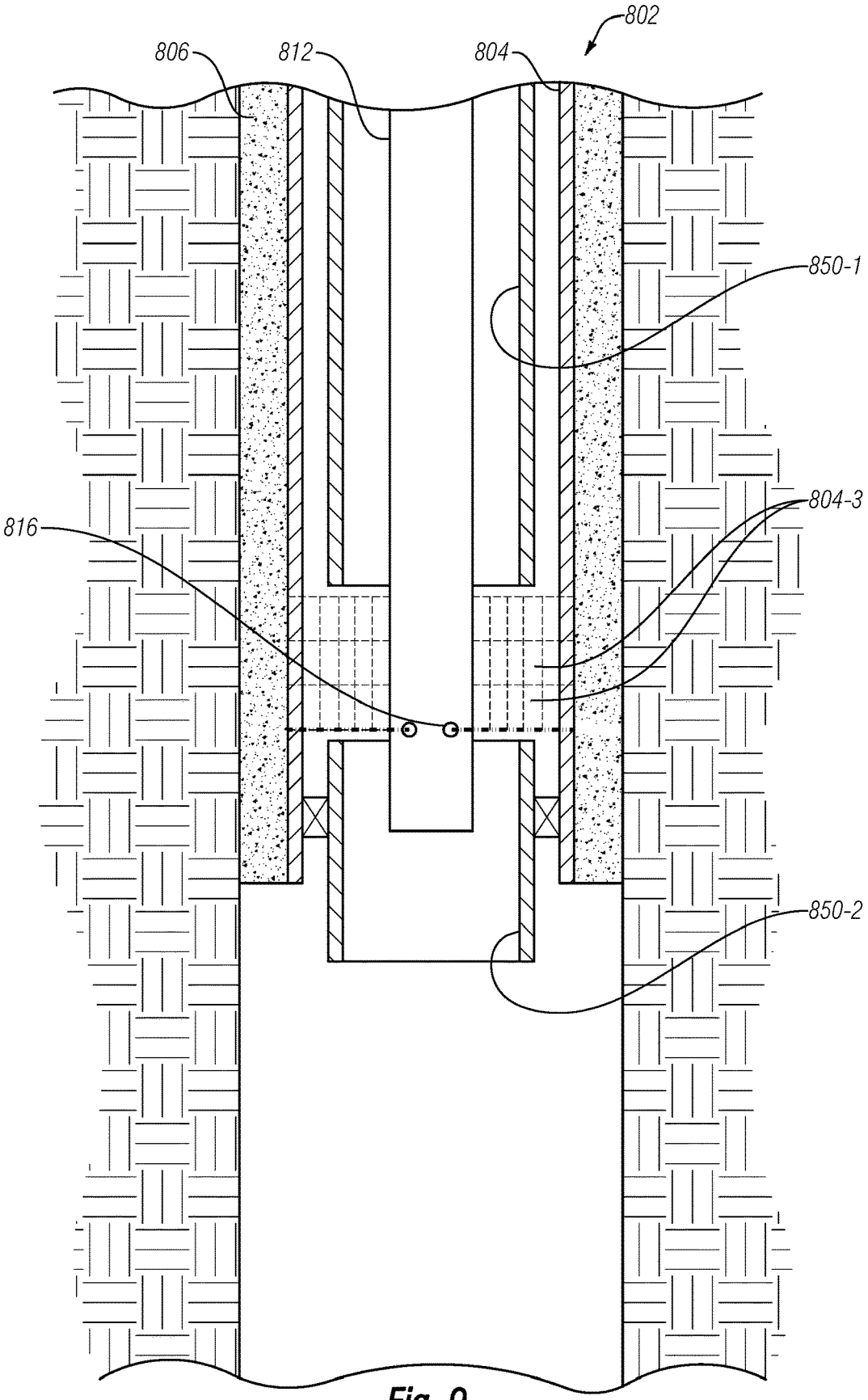
FIG. 9 is a cross-sectional view of a wellbore showing a lower portion of the downhole component separated from an upper portion of the downhole tool and allowing the downhole cutting tool to cut the casing through the downhole component, according to one or more embodiments disclosed.

In some embodiments of the present disclosure, cutting of casing may occur using a tool that cuts/mills casing directly, although in other embodiments, the casing may be cut during or after cutting/milling through another downhole tool or component. FIGS. 8 and 9, for instance, illustrate an example embodiment of a downhole cutting tool 812 used within a wellbore 802 that has casing 804 installed therein using cement 806. Another downhole component 850 may be positioned in the wellbore 802 and inside the casing 804. The downhole component 850 may include a tubular, a downhole tool, an isolation tool, a completion tool/assembly, or the like. In the illustrated example, the downhole component 850 is separate from the casing 804 and may be a completion assembly. In this particular embodiment, one or more isolation elements 852 (e.g., packers) may be positioned radially-between the casing 804 and the downhole component 850.

When the downhole cutting tool 812 is used to cut the casing 804, the downhole cutting tool 812 (or another downhole cutting tool 812) may be run inside the downhole component 850 and may cut the downhole component 850 to provide an opening for cutting the casing 804. In other embodiments, the downhole component 850 may be removed (e.g., raised to the surface using a rig) prior to the running of the downhole cutting tool 812.

The downhole cutting tool 812 may operate in a manner similar to the downhole cutting tool 112 of any of FIGS. 2-4. For instance, the downhole cutting tool 812 may include one or more lasers 816, abrasive jets, plasma mills, torch cutters, or the like. The downhole cutting tool 812 may be activated and the lasers 816 or other cutting tools operated to cut the downhole component 850 to form an upper portion 850-1 and a lower portion 850-2. In some embodiments, the portion of the downhole component 850 between the upper and lower portions 850-1, 850-2 may form an additional segment, or such portion may be cut into a plurality of segments 850-3. After being cut and formed by the lasers 816 or other components of the downhole cutting tool 812, the segments 850-3 may fall into the sump of the wellbore 802 and/or onto one or more isolation elements 852, leaving an axial gap between the upper and lower portions 850-1, 850-2. The lower portion 850-2 may, in some embodiments, be held in place by the isolation element 852. The isolation element 852 may either remain in place or be milled out, thereby allowing the lower segment 850-2 to fall within the wellbore 802. As shown in FIG. 9, after the segments 850-3 of the downhole component 850 have been removed to form a gap between the upper and lower portions 850-1, 850-2, the one or more lasers 816 may be activated, deactivated, rotated, raised, lowered, or otherwise moved or operated to form one or more segments 804-3 in the casing 804. In some embodiments, the downhole cutting tool 812 may be operated to perform other functions, such as cement quality monitoring, underreaming, casing segment removal, and the like.

Figure 10:
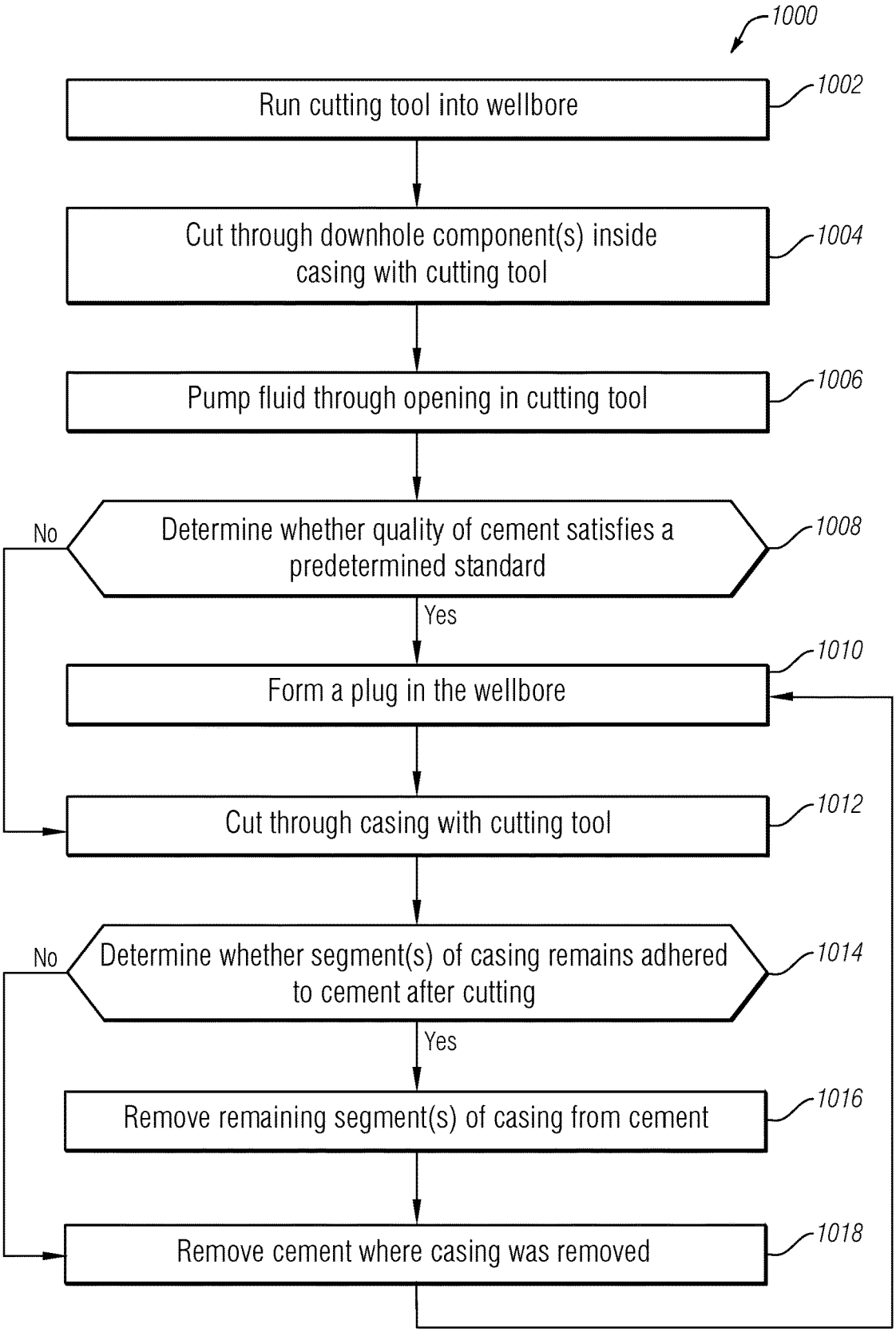
FIG. 10 is a flowchart of a method for abandoning the wellbore, according to one or more embodiments disclosed.

FIG. 10 is a flowchart depicting a method 1000 for abandoning a wellbore, according to one or more embodiments disclosed. The method 1000 may be performed using one or more downhole cutting tools as described herein (e.g., downhole cutting tool 112 of FIGS. 2-4 or downhole cutting tool 812 of FIGS. 8 and 9), or using other cutting tools. Thus, as will be appreciated in view of the disclosure herein, a variety of downhole tools may be used to perform the method 1000. Moreover, the downhole cutting tools described herein may also be used to perform other methods in addition to the method 1000 of FIG. 10.

In the method 1000, a cutting tool may be run into the wellbore at 1002. The downhole cutting tool may be located directly within casing, or it may be run to a position within another downhole component. In embodiments in which the cutting tool is located within another downhole component, the downhole cutting tool may be operated to cut through the downhole component inside the casing at 1004. This may be done by, for instance, operating a cutting tool using laser, jet abrasive, plasma, torch, or other cutting components. In some embodiments, the downhole component cut using the cutting tool is a completion assembly. An example completion assembly may include a smaller bore production tubular. The tubular may extend from the reservoir to a surface production wellhead. The tubular may be similar to standard drill pipe, but in some embodiments may be made of a different material (e.g., chrome-based alloys). In some embodiments, the completion assembly may have a control line on the outer diameter that is clamed in one or more locations to a production packer (e.g., isolation elements 852 of FIG. 8) at a reservoir zone. When the completion assembly or other downhole component is cut, a window or section may be removed to allow the cutting tool access to the cemented casing.

In some embodiments of the method 1000, a fluid may be pumped through an opening in the cutting tool 1006. The fluid may be used to, for instance, provide a clean environment in which a laser or other cutting device may operate. Thus, pumping the fluid at 1006 may occur during or even before cutting the downhole component at 1004. In other embodiments, the fluid may be pumped at 1006 after cutting the downhole component at 1004. Where a wellbore is to be abandoned, the quality of cement around casing may also be determined at 1008. This may also be performed after cutting the downhole component at 1004; however, in other embodiments it may be performed during or before cutting the downhole component. In at least some embodiments, determining the quality of the cement at 1008 may be performed using a tool other than the cutting tool (e.g., in a separate trip), although the quality of cement may also be determined at 1008 using the cutting tool itself, and potentially in the same trip used to cut a downhole component at 1004 or to cut the casing at 1012, discussed hereafter. Determining the quality of the cement at 1008 may include operating a sensor to detect any number of properties of the cement, as discussed herein.

Where it is determined that the quality of the cement satisfies a predetermined standard, a plug may be formed in the wellbore at 1010. Forming the plug may include pumping cement, epoxy, or another fluid into the wellbore and delivering the fluid to a site of the plug using the cutting tool or another tool. The plug may be formed as the fluid is allowed to cure. In the same or other embodiments, forming the plug at 1010 may include delivering an isolation or support device such as a packer or bridge plug. Such device may itself be used as the plug, or may be used as a support on which a cement, epoxy, or other plug is formed. In some embodiments, metals, alloys, or the like may be inserted into the wellbore and melted to form the plug at 1010.

If the quality of the cement is determined at 1008 to be below the predetermined or threshold standard, the method 100 may skip forming the plug and may instead include cutting the casing with the cutting tool at 1012. Cutting the casing with the cutting tool may include operating a laser, abrasive jet, plasma, torch, or other cutting device to cut the casing into one or more segments. Optionally, cutting the casing at 1012 may include removing the cut casing and/or forming a gap between casing sections. In the gap, cement and/or formation may be exposed to the wellbore. Removal of the cut casing may, in some embodiments, occur automatically, such as the action of residual hoop stresses. In other embodiments, the cutting process may itself create forces that cause the cut segments of the casing to fall off the cement (e.g., heating may cause expansion of casing segments, fluid forces may vibrate the casing segments, etc.).

Optionally, one or more casing segments may remain adhered to the cement after cutting, and the cutting tool or another downhole tool may be used to determine whether there are remaining casing segments at 1014. Such determination may include using one or more mechanical, electrical, acoustic, magnetic, or other sensors. If the determination at 1014 indicates there are no remaining segments of casing (or if above a threshold amount of casing is removed even if some casing remains), at 1018 cement may optionally be removed in the section where the casing was removed. This may include, for instance, activating an underreamer on the cutting tool, tripping in a separate tool with an underreamer, using abrasives or other tools to wash away the cement, or other techniques and tools.

If the determination at 1014 indicates that segments of casing remain adhered to the cement (or if an insufficient amount of casing is removed), remaining segments of casing may be removed at 1018. Removing segments of casing may include, for example, using the underreamer to knock the segments loose, activating a sonic or acoustic device to vibrate the casing, using fluids or heat to degrade the bond with the cement, or other techniques or tools. Thereafter, when sufficient casing segments have been removed, cement may be removed at 1018 as discussed herein. A plug may then be formed in the wellbore 1010 as discussed previously. In some embodiments, the plug that is formed may be formed at least partially in section of the wellbore where casing and/or cement are removed. For instance, a cement plug may be formed in the wellbore, with the cement filling at least some of the area that is reamed or where cement is removed to create a wall-to-wall, rock-to-rock plug which directly engages the formation wall.

Certain terms are used throughout the following description and claims to refer to particular features or components. As those having ordinary skill in the art will appreciate, different persons may refer to the same feature or component by different names. This document does not intend to distinguish between components or features that differ in name but not function. The figures may be to scale for some but not each embodiment contemplated as within the scope of the present disclosure. Certain features and components herein may be shown exaggerated in scale or in somewhat schematic form and some details of conventional elements may not be shown or described in interest of clarity and conciseness.

In the following discussion and in the claims, the terms "including" and "comprising" are used in an open-ended fashion, and thus should be interpreted to mean "including, but not limited to . . . ". Also, the terms "couple," "coupled," "couples," and the like are intended to mean either an indirect or direct connection. Thus, if a first component is coupled to a second component, that connection may be through a direct connection, or through an indirect connection via other components, devices, and connections. Further, the terms "axial" and "axially" mean generally along or parallel to a central or longitudinal axis, while the terms "radial" and "radially" mean generally perpendicular to a central or longitudinal axis.

Additionally, directional or relational terms, such as "above," "below," "upper," "lower," etc., are used for convenience in referring to the accompanying drawings. In general, "above," "upper," "upward," and similar terms refer to a direction toward the earth's surface from below the surface along a wellbore, and "below," "lower," "downward," and similar terms refer to a direction away from the earth's surface along the wellbore, i.e., into the wellbore, but are meant for illustrative purposes, and the terms are not meant to limit the disclosure. For example, a component of a downhole tool that is "below" another component may be more downhole while within a vertical wellbore, but may have a different orientation during assembly, when removed from the wellbore, or in a deviated borehole. Accordingly, relational descriptions are intended solely for convenience in facilitating reference to various components, but such relational aspects may be reversed, flipped, rotated, moved in space, placed in a diagonal orientation or position, placed horizontally or vertically, or similarly modified. Relational terms may also be used to differentiate between similar components; however, descriptions may also refer to certain components or elements using designations such as "first," "second," "third," and the like. Such language is also provided merely for differentiation purposes, and is not intended to limit a component to a singular designation. As such, a component referenced in the specification as the "first" component may for some but not each embodiment be the same component that is referenced in the claims as a "first" component.

Furthermore, to the extent the description or claims refer to "an additional" or "other" element, feature, aspect, component, or the like, it does not preclude there being a single element, or more than one, of the additional elements. Where the claims or description refer to "a" or "an" element, such reference is not be construed that there is just one of that element, but is instead to be inclusive of other components and understood as "one or more" of the element. It is to be understood that where the specification states that a component, feature, structure, function, or characteristic "may," "might," "can," or "could" be included, that particular component, feature, structure, or characteristic is provided in some embodiments, but is optional for other embodiments of the present disclosure. The terms "couple," "coupled," "connect," "connection," "connected," "in connection with," and "connecting" refer to "in direct connection with," "integral with," or "in connection with via one or more intermediate elements or members."

Although various example embodiments have been described in detail herein, those skilled in the art will readily appreciate in view of the present disclosure that many modifications are possible in the example embodiments without materially departing from the present disclosure. Accordingly, any such modifications are intended to be included in the scope of this disclosure. Likewise, while the disclosure herein contains many specifics, these specifics should not be construed as limiting the scope of the disclosure or of any of the appended claims, but merely as providing information pertinent to one or more specific embodiments that may fall within the scope of the disclosure and the appended claims.

Any described features from the various embodiments disclosed may be employed in combination. Acts of a method may be performed in any order, including with certain actions occurring in parallel. Other embodiments of the present disclosure may be devised which lie within the scopes of the disclosure and the appended claims. Each addition, deletion, and modification to the embodiments that falls within the meaning and scope of the claims is to be embraced by the claims.

Although a few example embodiments have been described in detail herein, those skilled in the art will readily appreciate that many modifications are possible to the example embodiments without materially departing from this disclosure. Accordingly, any such modifications are intended to be included within the scope of this disclosure. In the claims, means-plus-function clauses are intended to cover the structures described herein as performing the recited function, including both structural equivalents and equivalent structures. It is the express intention of the applicant not to invoke means-plus-function or other functional interpretation, except for those in which the claim expressly uses the words "means for" together with an associated function.

Certain embodiments and features may have been described using a set of numerical values that may provide lower and upper limits. It should be appreciated that ranges including an upper limit, a lower limit, or the combination of any two values to define lower and upper limits are contemplated unless otherwise indicated. Any numbers, percentages, ratios, measurements, or other values stated herein are intended to include the stated value as well as other values that are about or approximately the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least experimental error and variations that would be expected by a person having ordinary skill in the art, as well as the variation to be expected in a suitable manufacturing or production process. A value that is about or approximately the stated value and is therefore encompassed by the stated value may further include values that are within 5%, within 1%, within 0.1%, or within 0.01% of a stated value.

The Abstract at the end of this disclosure is provided to allow the reader to quickly ascertain the general nature of some embodiments of the present disclosure. It is submitted with the understanding that it will not be used to interpret or limit the scope or meaning of the claims.

What is claimed is:

1. A downhole tool for preparing a wellbore in a formation for plugging, comprising:

a cutting tool coupled to a body and configured to perform an operation to remove an axial section of a length of casing within a wellbore;

the body defining at least one opening through which a stream of fluid is configured to flow radially outward;

one or more sensors coupled to the body and configured to perform at least one of:

measuring a quality of cement in an annulus surrounding an outer wall of the axial section of the length of casing; and determining, after performing the operation to remove the axial section of the length of casing, whether at least a portion of the axial section of the length of casing remains adhered to cement in the annulus.

2. The downhole tool of claim 1, wherein the one or more sensors comprises at least one sensor configured to transmit and receive a signal that bounces off of the casing or the cement, a magnetometer, one or more radially-expandable arms, a micrometer, or a laser.

3. The downhole tool of claim 1, further comprising:

a casing removal tool coupled to the body and configured to separate from the cement the at least a portion of casing adhering to the cement after the removal operation.

4. The downhole tool of claim 3, wherein the casing removal tool includes at least one of a canister configured to generate a pressure pulse or one or more radially-expandable arms.

5. The downhole tool of claim 1, further comprising:

an underreamer coupled to the body and configured to remove at least a portion of cement along the axial section of the wellbore where the length of casing is cut.

6. A method, for plugging a cased wellbore, comprising:

running a downhole tool into a wellbore in a formation, the wellbore being at least partially lined with a length of casing and an annulus surrounding the casing at least partially filled with cement;

the downhole tool including at least one sensor, the at least one sensor including a sensor for determining a quality of the cement in the annulus;

determining, using the sensor for determining the quality of the cement, whether the quality of the cement in the annulus along an axial section of the casing having a length less than the length of the casing satisfies a predetermined standard;

if the quality of the cement along the axial section satisfies a predetermined standard, performing a removal operation on the axial section of the casing without removing the cement within the annulus along the axial section; otherwise, performing a removal operation on the axial section of the casing and at least a portion of the cement in the annulus along the axial section of the casing; and forming a plug at least partially where the axial section of the casing was removed, p1 wherein the at least one sensor includes a second sensor, and wherein the method further comprises, after completing the removal operation on the axial section of casing, determining with the second sensor whether any of the axial section of the casing remains adhered to the cement.

7. The method of claim 6, wherein the second sensor includes a magnetometer configured to measure whether one or more metals are present in an area, a presence of the one or more metals indicating that at least a portion of the axial section of the casing remains adhered to the cement after performing the removal operation.

8. The method of claim 6, wherein the second sensor includes one or more radially-expandable arms configured to determine whether at least a portion of the axial section of the casing remains adhered to the cement after performing the removal operation.

9. The method of claim 6, wherein the second one of the at least one sensor includes a micrometer or laser configured to measure a distance to a surface radially-outward therefrom, wherein the distance that is measured indicates whether at least a portion of the axial section of the casing remains adhered to the cement after the removal operation on the casing.

10. The method of claim 6, wherein the removal operation on the axial section of the casing and at least a portion of the cement in the annulus along the axial section of the casing is performed with an underreamer.

11. The method of claim 10, wherein the method further comprises tripping the downhole tool out of the wellbore; and tripping a second downhole tool into the wellbore, the second downhole tool including the underreamer.

12. The method of claim 6, wherein the second sensor is configured to transmit and receive a return signal, and wherein a travel time or change to properties of the signal indicates whether at least a portion of the axial section of the casing remain adhered to the cement.

13. The method of claim 12, wherein, in response to determining that at least a portion of the axial section of the casing remains adhered to the cement removing the at least a portion of the axial section of the casing that remains adhered to the cement from the cement with a casing removal tool.

14. The method of claim 13, wherein the casing removal tool generates a pressure pulse to remove the portion of the axial section of the casing that remains adhered to the cement.

15. The method of claim 13, wherein the casing removal tool comprises one or more radially-expandable arms.

16. A method for abandoning a wellbore, comprising:

running a downhole cutting tool into a wellbore in a formation, the wellbore having a casing and an annulus between the outer wall of the casing and the formation, the annulus being at least partially filled with cement, the downhole cutting tool includes a cutting element including at least one of a laser, plasma cutter, or abrasive jet;

using one or more sensors to locate a section along the length of the wellbore in which a quality of the cement in the annulus meets a predetermined standard;

using the cutting tool to cut an axial section of the casing in the section along the length of the wellbore in which the quality of the cement in the annulus meets the predetermined standard;

using one or more sensors, determining that one or more segments of casing remain adhered to cement within the axial section of casing;

after cutting the axial section of casing and determining that the one or more segments of casing remain, removing the one or more segments of casing using one or more casing removal tools;

forming a plug in the wellbore, the plug being formed at least partially where the axial section of casing was cut;

cutting a completion assembly with the cutting tool to separate the completion assembly into first and second segments, wherein the completion assembly is positioned radially-outward from the downhole cutting tool and radially-inward of the casing:

pumping a stream of fluid radially-outward through an opening in the downhole cutting tool, the cutting element extending at least partially through the stream during cutting; and removing at least a portion of the cement proximate to where the axial section of the casing was cut, using an underreamer.

* * * * *